United States Patent [19]

Heater, Jr.

[11] 4,074,948

[45] Feb. 21, 1978

[54] PAVEMENT MAT AND PROCESS

[76] Inventor: Guy C. Heater, Jr., 4 Suydam Drive, Melville, N.Y. 11746

[21] Appl. No.: 684,275

[22] Filed: May 7, 1976

[51] Int. Cl.[2] ..... E01C 5/22

[52] U.S. Cl. ..... 404/75; 404/35

[58] Field of Search ..... 404/35, 32, 33, 82, 404/75, 19, 20, 17

[56] References Cited

U.S. PATENT DOCUMENTS

| | | | |
|---|---|---|---|
| 1,854,512 | 4/1932 | Heppes | 404/35 X |
| 3,253,521 | 5/1966 | Endres | 404/32 X |
| 3,272,098 | 9/1966 | Buchholtz | 404/32 |
| 3,400,644 | 9/1968 | Baskin | 404/35 X |
| 3,568,579 | 3/1971 | Hoad | 404/35 |
| 3,801,421 | 4/1974 | Allen | 404/32 X |
| 3,891,585 | 6/1975 | McDonald | 404/32 X |
| 3,915,581 | 10/1975 | Copp | 404/32 |
| 3,930,100 | 12/1975 | McDonald | 404/32 X |

FOREIGN PATENT DOCUMENTS

| | | | |
|---|---|---|---|
| 1,015,746 | 1/1966 | United Kingdom | 404/35 |

*Primary Examiner*—Nile C. Byers

[57] ABSTRACT

A pavement mat is disclosed comprising a fibrous mat impregnated with a bituminous material and an aggregate. The bottom layer of the mat has an adhesive such as an asphalt base adhesive on it whereas the top layer comprises a wear surface. A release coating such as rock or slate dust is applied to the adhesive so that the mats may be stacked one on top of the other without sticking to one another, the release coating also being forced into the adhesive when the mat is placed on a road surface which has been prepared by being swept and sprayed with a solvent (i.e., kerosene or No. 2 fuel oil) so that the adhesive layer may be bonded to the road surface.

A process for resurfacing a road with such mats is disclosed comprising placing a plurality of mats on a first vehicle and partially removing one of the mats from the vehicle by means of chain attached to an anchor vehicle and to the mat with spring clamps so that a relatively small portion of the adhesive surface of the mat is placed on the road surface. A second vehicle is wheeled onto that portion of the mat that is placed on the road surface to hold the mat in place and the first vehicle is pulled forward until the entire mat is removed. The second vehicle is then wheeled over the mat that is completely on the road surface so that the mat is adhered and the process repeated until all of the mats are applied.

7 Claims, 1 Drawing Figure

PAVEMENT MAT AND PROCESS

SUMMARY OF THE INVENTION

The present invention relates to a pavement mat comprising a fibrous mat impregnated with a mixture of bituminous material and aggregate, the mat having a wear surface and a bottom surface. A bituminous adhesive layer extends along the bottom surface of the mat, a release coating being placed on the adhesive layer for preventing the mats from adhering to one another when stacked one on top of the other, bottom surface to wear surface. The release coating is forced into the adhesive surface by pressure applied to the wear surface or dissolved by the solvent such as kerosene of fuel oil sprayed on the road surface when the mat is in place on a road. In one embodiment the release coating comprises an inorganic compound such as at least one member selected from the group consisting of a silicon dioxide material and especially a finely divided silicon dioxide material known in the art as "Cab-O-Sil" (trademark) or a clay material. Rock dust or slate dust may be used.

In another embodiment, the present invention relates to a process for the surfacing of a pavement comprising delivering a plurality of adhesive backed pavement mats on a first vehicle to a road surface, the road surface being selected from at least one member of the group consisting of a bituminous, concrete and metal surfaces. The plurality of mats are stacked one on top of the other bottom surface to wear surface, after which one end of the top mat in the plurality is placed on the road surface so that the adhesive backing thereon is in contact with the road which has been swept and sprayed with the aforementioned solvent. The portion of this mat so placed on the road is secured thereto by a second wheeled vehicle, wheeled onto the mat, the second wheeled vehicle being sufficiently heavy to bond the adhesive layer to the road when the second vehicle is wheeled over the mat, and any further vehicular traffic will bind the mat permanently to the road surface. The first vehicle is then moved forward until the mat is pulled off the first vehicle after which the second vehicle is wheeled over the entire length of the mat to bond the mat to the road surface. The process is repeated until each mat of the plurality is applied to the road.

DETAILED DESCRIPTION

Figure 1:
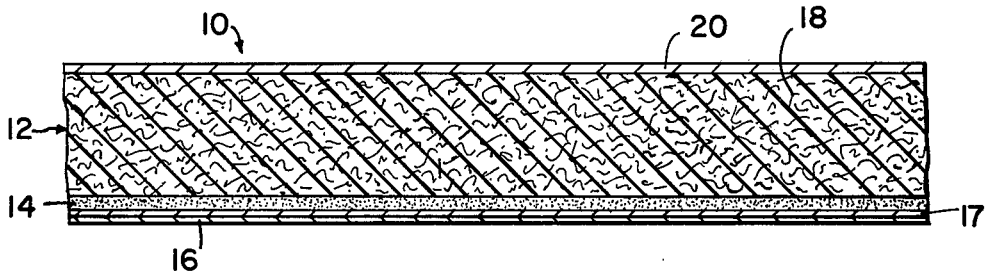
FIG. 1 illustrates a cross-section of a pavement mat having a wear surface on top of a bituminous layer containing aggregate and reinforcing fibers, an adhesive layer and a release coating on the adhesive layer according to an embodiment of the invention.

Pavement mats for surfacing or resurfacing road surfaces are disclosed in the prior art U.S. Pat. Nos. 3,625,119 Gagle; 3,844,128 Harrison; 3,400,644 Baskin; 1,881,660 Keller, Jr.; 1,712,965 Maranville; 1,586,674 Hartel; and 1,281,444 Wardell.

A difficulty encountered in the prior art comprises stacking a plurality of pavement mats one on top of the other so that they do not adhere to one another. Another problem encountered in the prior art is to provide a plurality of mats that may be stacked one on top of the other so that the top mat may be freely removed with the adhesive surface thereon pointing downwards towards a road surface to which the mat is to be applied.

This type of arrangement would lend itself to the application of these mats to a road surface in a very efficient and speedy manner.

It is therefore an object of the present invention to overcome these and other difficulties encountered in the prior art.

It is a further object of the present invention to provide a novel pavement mat.

It is a further object of the present invention to provide a novel pavement mat having a wear surface and opposite the wear surface an adhesive surface which can be adhered to a road surface such as bituminous, concrete or metal road surface.

It is a further object of the present invention to provide novel pavement mats that may be stacked one on top of the other to form a plurality of mats that will not adhere to one another prior to the application thereof onto a road surface.

It is also an object of the present invention to provide a novel method for the application of paving mats to a road surface.

These and other objects have been achieved according to the present invention and will become apparent from the disclosure and claims that follow and the appended drawing.

Referring to the drawing, a mat 10 is illustrated having a wear surface 20 on top of a bituminous layer 12, said layer 12 comprising a mixture of a bituminous material and an aggregate reinforced with fibers 18. An adhesive layer 14 is positioned on the bottom of layer 12, layer 16 having an inorganic release coating 17 thereon which is forced into the layer 14 when the mat 10 is adhered to a road surface or dissolved by the solvent sprayed on the road surface.

The pavement mat of the present invention comprises a fibrous mat, i.e., a mat made of glass fibers, carbon fibers, steel fibers, or other metal fibers, polypropylene fibers, Nylon, Dacron (trademarks) and polyethylene fibers and the art known equivalents thereof. The mat is impregnated with a bituminous material such as asphalt, tar, pitch and other art known heavy residues from petroleum distillation, the bituminous material being combined with an aggregate such as small stone, sand and various mixtures thereof. The bottom of the mat has a layer of bituminous material as defined above which is substantially free of aggregate in order to provide an adhesive layer. The mat may be anywhere from about $\frac{1}{4}$ inch to about four inches thick especially from about $\frac{1}{2}$ inch to about $\frac{3}{4}$ inch thick, the adhesive layer on the bottom being anywhere from about 1/16 of an inch to about one inch thick especially from about $\frac{1}{8}$ of an inch to about $\frac{1}{4}$ of an inch thick. The mats may be supplied in any width or length, however, in order to provide a seamless surface for a highway, the mats are supplied in 8 to 12 feet widths and anywhere from about 10 to about 15 foot lengths or the legal length of flat bed trailers.

The adhesive layer in turn is coated with an inorganic release coating such as silicon dioxide material including stone dust, or any powdery material containing silicon dioxide such as sand, Cab-O-Sil (trademark), a finely divided silicon sold by the Godfrey L. Cabbott Company of Boston, Mass. or a clay coating (e.g., attapulgite, kaolin mont morillonite and the like). The coating may be applied to the surface in an amount anywhere from about 5 ounces per square foot up to about 15 ounces per square foot, the amount varying depending upon the thickness and the composition of the adhesive layer and the particle size of the release coating.

The adhesive layer is formulated so that the release coating may be forced into the adhesive surface by pressure applied to the wear surface of the mat when the mat is in place on a road surface.

In order to promote the adhesion of the pavement mat to a road surface, the road surface may be sprayed lightly with kerosene or No. 2 fuel oil to soften the adhesive layer of the mat.

In use, a plurality of mats are placed on the bed of a vehicle such as a truck and delivered to the road surface site which is to be paved. Because the mats do not adhere to one another, the mats may be conveniently stacked one on top of the other with the adhesive layer down and once delivered to a road to be surfaced, the top mat may be partially moved from the stack by means of chains attached to an anchor vehicle and to the mat with spring clamps so that a portion of the adhesive layer of the top mat is in contact with a road surface. A second wheeled vehicle is rolled onto the edge of the top mat, that is partially applied to the road surface which has been prepared by being swept and sprayed with solvent and the first vehicle is moved forward thereby pulling the top mat off of the stack. The second vehicle then is wheeled over the mat just applied to the road thereby bonding the adhesive layer to the road surface and causing the release coating to be forced upwards into the adhesive and become a part of the mat. For this reason, it is desirable to provide a release coating which very closely resembles the aggregate employed in the bituminous material used for the fabrication of the mat. This process is repeated until all of the mats are removed from the first vehicle.

OTHER APPLICATIONS OF THE INVENTION

1. Non-skid mat made with a top surface of used rubber and sharp grit.

2. Small patching — after loose, hot, asphalt has been used for filling a chock hole — a slightly larger piece of pavement mat can be placed over the hole to keep traffic from lifting the filling out.

3. Resurfacing over existing:

(a) tennis courts — with proper mixture; colors; lines;

(b) Driveways — in color;

(c) Pool areas and patios — non-slip surface in color and texture.

Although the invention has been described by reference to some embodiments, it is not intended that the novel pavement mat or process be limited thereby, but that modifications thereof are intended to be included as falling within the broad spirit and scope of the foregoing disclosure, and the following claims.

What is claimed is:

1. A pavement mat comprising a fibrous mat impregnated with a mixture of bituminous material and aggregate, said mat having a wear surface and bottom surface, a bituminous adhesive layer extending along said bottom surface, a particulate inorganic release coating on said adhesive layer for preventing said mats from adhering to one another when stacked one on top of the other, bottom surface to wear surface, said release coating being forced into said adhesive surface by pressure applied to said wear surface when said mat is in place on a road surface.

2. The pavement mat of claim 1 where said release coating is selected from at least one member of the group consisting of a silicon dioxide material and a clay.

3. The pavement mat of claim 2 where said silicon dioxide comprises a finely divided silicon dioxide.

4. A process for the surfacing of a pavement comprising delivering a plurality of adhesive backed pavement mats on a first vehicle to a road surface, said road surface selected from at least one member of the group consisting of bituminous, concrete and metal surfaces, said plurality of mats being stacked one on top of the other, bottom surface to wear surface placing one end of the top mat in said plurality on said road surface so that said adhesive back is in contact with said road and securing said end so placed by a second wheeled vehicle, said second wheeled vehicle being sufficiently heavy to bond said adhesive back to said road when said second vehicle is wheeled over said mat, moving said first vehicle forward until said mat is pulled off of said first vehicle, wheeling said second vehicle over said mat to bond said mat to said road surface, repeating said process until each mat of said plurality is applied to said road, said pavement mat comprising a fibrous mat impregnated with a mixture of bituminous material and aggregate, said mat having a wear surface and bottom surface, a bituminous adhesive layer extending along said bottom surface, a particulate inorganic release coating on said adhesive layer for preventing said mats from adhering to one another when stacked one on top of the other, bottom surface to wear surface, said release coating being forced into said adhesive surface by pressure applied to said wear surface when said mat is in place on a road surface.

5. The process of claim 4 where said pavement mat comprises a fibrous mat impregnated with a mixture of bituminous material and aggregate, said mat having a wear surface and bottom surface, a bituminous adhesive layer extending along said bottom surface, a release coating on said adhesive layer for preventing said mats from adhering to one another when stacked one on top of the other, bottom surface to wear surface, said release coating being forced into said adhesive surface by pressure applied to said wear surface when said mat is in place on a road surface.

6. The process of claim 4 where said release coating is selected from at least one member of the group consisting of a silicon dioxide material and a clay.

7. The process of claim 6 where said silicon dioxide comprises a finely divided silicon dioxide.

* * * * *